US006736916B2

(12) United States Patent
Steinke et al.

(10) Patent No.: US 6,736,916 B2
(45) Date of Patent: May 18, 2004

(54) HYDRAULICALLY ARRANGED NONWOVEN WEBS AND METHOD OF MAKING SAME

(75) Inventors: Tara Tryphena Steinke, Anaheim, CA (US); Jay Sheldon Shultz, Roswell, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 67 days.

(21) Appl. No.: 10/004,615

(22) Filed: Nov. 1, 2001

(65) Prior Publication Data

US 2002/0074697 A1 Jun. 20, 2002

Related U.S. Application Data

(60) Provisional application No. 60/257,246, filed on Dec. 20, 2000.

(51) Int. Cl.[7] ..... D04H 1/46
(52) U.S. Cl. ..... 156/167; 156/148
(58) Field of Search ..... 156/167, 308.2, 156/148; 28/104, 105

(56) References Cited

U.S. PATENT DOCUMENTS

| | | | |
|---|---|---|---|
| 2,862,251 | A | 12/1958 | Kalwaites |
| 3,025,585 | A | 3/1962 | Griswold |
| 3,033,721 | A | 5/1962 | Kalwaites |
| 3,042,576 | A | 7/1962 | Harmon et al. |
| 3,081,500 | A | 3/1963 | Griswold et al. |
| 3,081,512 | A | 3/1963 | Griswold |
| 3,137,893 | A | 6/1964 | Gelpke |
| 3,284,857 | A | 11/1966 | Hynek |
| 3,338,992 | A | 8/1967 | Kinney |
| 3,341,394 | A | 9/1967 | Kinney |
| 3,423,266 | A | 1/1969 | Davies |
| 3,485,695 | A | 12/1969 | Ness |
| 3,485,706 | A | 12/1969 | Evans |
| 3,494,821 | A | 2/1970 | Evans |
| 3,498,874 | A | 3/1970 | Evans et al. |
| 3,502,763 | A | 3/1970 | Hartmann |
| 3,542,615 | A | 11/1970 | Dobo et al. |
| 3,595,731 | A | 7/1971 | Davies |
| 3,681,182 | A | 8/1972 | Kalwaites |
| 3,692,618 | A | 9/1972 | Dorschner et al. |
| 3,747,161 | A | 7/1973 | Kalwaites |
| 3,802,817 | A | 4/1974 | Matsuki et al. |
| 3,837,046 | A | 9/1974 | Kalwaites |
| 3,906,130 | A | 9/1975 | Tsurumi et al. |
| 4,016,317 | A | 4/1977 | Kalwaites |

(List continued on next page.)

FOREIGN PATENT DOCUMENTS

| | | |
|---|---|---|
| EP | 0586924 | 3/1994 |
| EP | 1039006 | 9/2000 |
| WO | WO 95/06769 | 3/1995 |
| WO | 98/23804 | 6/1998 |
| WO | 00/20675 | 4/2000 |
| WO | WO 00/22218 | 4/2000 |

OTHER PUBLICATIONS

JP 10–046,461, Abstract, Feb. 17, 1998, Oji Paper Co.

PCT International Search Report, Feb. 20, 2003, for International Application No. PCT/US 01/48858.

*Primary Examiner*—Sam Chuan Yao
(74) *Attorney, Agent, or Firm*—Robert A. Ambrose; Douglas H. Tulley, Jr.

(57) ABSTRACT

A process of forming a nonwoven fabric is disclosed which comprises the steps of forming a precursor web of multicomponent substantially continuous filaments, exposing the precursor web to a hydraulic arrangement treatment to form apertures without causing substantial filament entanglement, and thereafter forming inter-filament bonds and an integrated web. The resulting apertured nonwoven fabrics have good hand and tactile aesthetics and have a great variety of uses including use in absorbent personal care products, garments, medical applications, and cleaning applications.

20 Claims, 4 Drawing Sheets

U.S. PATENT DOCUMENTS

| | | | | | |
|---|---|---|---|---|---|
| 4,152,480 | A | | 5/1979 | Adachi et al. | |
| 4,276,681 | A | * | 7/1981 | Marshall | 28/105 |
| 4,340,563 | A | | 7/1982 | Appel et al. | |
| 4,379,799 | A | | 4/1983 | Holmes et al. | |
| 4,588,630 | A | | 5/1986 | Shimalla | |
| 4,704,112 | A | | 11/1987 | Suzuki et al. | |
| 4,735,842 | A | | 4/1988 | Buyofsky et al. | |
| 4,840,829 | A | | 6/1989 | Suzuki et al. | |
| 5,026,587 | A | | 6/1991 | Austin et al. | |
| 5,098,764 | A | | 3/1992 | Drelich et al. | |
| 5,144,729 | A | | 9/1992 | Austin et al. | |
| 5,355,565 | A | | 10/1994 | Baravian | |
| 5,369,858 | A | | 12/1994 | Gilmore et al. | |
| 5,382,400 | A | | 1/1995 | Pike et al. | |
| 5,516,572 | A | | 5/1996 | Roe | |
| 5,622,772 | A | * | 4/1997 | Stokes et al. | 442/401 |
| 5,643,653 | A | | 7/1997 | Griesbach, III et al. | |
| 5,707,735 | A | * | 1/1998 | Midkiff et al. | 428/373 |
| 5,714,107 | A | | 2/1998 | Levy et al. | |
| 5,759,926 | A | * | 6/1998 | Pike et al. | 442/333 |
| 5,801,107 | A | | 9/1998 | Everhart et al. | |
| 5,989,004 | A | | 11/1999 | Cook | |
| 5,990,377 | A | | 11/1999 | Chen et al. | |

* cited by examiner

HYDRAULICALLY ARRANGED NONWOVEN WEBS AND METHOD OF MAKING SAME

This application claims priority from U.S. Provisional Application No. 60/257,246 filed on Dec. 20, 2000, the entire contents of which are expressly incorporated herein by reference.

TECHNICAL FIELD

The present invention generally relates to hydraulically arranged continuous filament nonwoven fabrics and methods of making the same.

BACKGROUND OF THE INVENTION

Nonwoven fabrics are useful for a wide variety of applications, including use as one or more components within personal care products. More specifically, nonwoven fabrics are commonly used within infant care items such as diapers, child care items such as training pants, feminine care items such as sanitary napkins, adult care items such as incontinence products, and personal hygienic care items such as facial and body wipes. Nonwoven fabrics have also found use in garments including protective workwear and medical apparel such as surgical gowns. Other nonwoven medical applications include nonwoven wound dressings and surgical dressings. Cleaning applications utilizing nonwovens include towels and wipes. Still other uses of nonwoven fabrics are well known in the art.

Nonwoven webs of continuous filaments made by meltspinning thermoplastic polymers are known in the art. Generally described, the process for making spunbond nonwoven fabrics includes extruding a thermoplastic polymeric material through a spinneret and drawing the extruded material into filaments with a stream of high velocity air to form a random web on a collecting surface. Such a method is referred to as meltspinning. Spunbond processes are generally defined in numerous patents including, for example, U.S. Pat. No. 4,340,563 to Appel, et al., and U.S. Pat. No. 3,802,817 to Matsuki, et al.

A particular type of spunbond utilizes multiple polymers in order to make multicomponent or bicomponent nonwoven polymeric fabrics. The term "multicomponent" refers to filaments formed from at least two polymer streams that have been spun together to form one filament, such that the filament has two or more distinct components arranged in distinct zones across the cross-section of the filament which extend along the length of the filament. Multicomponent filaments and methods of making the same are known in the art and, by way of example, are generally described in U.S. Pat. No. 5,382,400 to Pike et al., U.S. Pat. No. 5,989,004 to Cook and U.S. Pat. Nos. 3,423,266 and 3,595,731 both to Davies et al.

The characteristics or physical properties of nonwoven webs are controlled, at least in part, by the density or openness of the fabric. Generally speaking, nonwoven webs made from crimped filaments have a lower density, higher loft and improved resiliency compared to similar spunbond filament nonwoven webs of uncrimped filaments. Such lofty, low density webs exhibit cloth-like textural properties, e.g., softness, drapability and hand. Various methods of crimping melt-spun multicomponent filaments are known in the art. As disclosed in U.S. Pat. Nos. 3,595,731 and 3,423,266 to Davies et al., bicomponent fibers or filaments may be mechanically crimped and the resultant fibers formed into a nonwoven web or, if the appropriate polymers are used, a latent helical crimp produced in bicomponent fibers or filaments may be activated by heat treatment of the formed web. Alternatively, as disclosed in U.S. Pat. No. 5,382,400 to Pike et al., the heat treatment may be used to activate the latent helical crimp in the fibers or filaments before the fibers or filaments have been formed into a nonwoven web.

Nonwoven webs or fabrics used in personal care products, garments, medical applications, and cleaning applications may desirably have apertures or perforations through the web. Apertures are a useful means for fluid management or transport generally, and are particularly useful means for fluid intake and transport with respect to high viscosity fluids.

Apertures in nonwoven webs may be imparted by slitting or cutting through portions of the web followed by stretching of the nonwoven web to pull open apertures at the slits. However, aperturing or perforating by slitting through the web necessarily damages the integrity of the individual continuous filaments. Alternatively, as disclosed in U.S. Pat. No. 4,588,630 to Shimalla, apertures may be formed by heat and compression fusing of the web at discrete sites, followed by stretching of the nonwoven web to pull open apertures at the fused sites. However, aperturing by heat-fusing then stretching has the undesirable effect of leaving apertures the edges of which are defined by hard and potentially abrasive fused thermoplastic polymer, as well as damaging the integrity of the individual filaments.

Hydroentangling has also been used to impart apertures to a nonwoven web. Hydroentangling is a well known principle involving the use of high pressure, needle-fine water jets to cause substantial filament entanglement such that the individual fibers or filaments are intertwined and entangled about one another to a high degree. This high degree of filament entanglement gives functional integrity to the web structure and forms a highly entangled and consolidated fibrous structure. Basic principles of hydroentangling are disclosed in U.S. Pat. Nos. 3,485,706 and 3,494,821 both to Evans. Examples of using hydroentangling processes to effect entanglement bonding and aperturing of webs of staple length fibers are disclosed in U.S. Pat. Nos. 3,747,161 and 4,016,317 both to Kalwaites, U.S. Pat. No. 4,379,799 to Holmes et al., and U.S. Pat. No. 4,735,842 to Buyofsky, et al. In order to impart substantial filament entanglement and give the web structure functional integrity, water pressures from as high as 200 pounds per square inch (psi) to 5,000 psi are described as necessary. However, use of high pressure water in these hydroentangling processes tends to densify or compact the nonwoven web, destroying its loft. Additionally, the mechanical requirements for high pressure hydroentangling such as pumping systems able to operate at high pressures, complex nozzles able to produce high-pressure, needle-fine water jets, and extensive water filtration systems to prevent clogging of the fine jet nozzles are cost prohibitive.

There exists a need for an economically produced apertured nonwoven material retaining high overall loft and, in particular, wherein the loft of the material subjected to an aperturing process is not substantially decreased by the aperturing process. There further exists a need for a high loft apertured nonwoven material wherein the edges of the apertures are unfused, thereby providing a soft fabric with good hand and pleasing tactile aesthetics. Still furthermore, there exists a need for a high loft apertured material having soft aperture edges wherein the integrity of the filaments of the web has not been compromised by a destructive aperturing process.

SUMMARY OF THE INVENTION

The aforesaid needs are fulfilled and the problems experienced by those skilled in the art overcome by a nonwoven web made by a process comprising the steps of forming a precursor web of multicomponent substantially continuous filaments, exposing the precursor web to a hydraulic arrangement treatment to form apertures without causing substantial filament entanglement, and thereafter autogenously bonding the web.

In one aspect of the invention, the precursor web comprises a lofty web of crimped multicomponent substantially continuous filaments. In a further aspect of the invention, the precursor web comprises multicomponent substantially continuous filaments which possess latent crimp, which latent crimp is activated after the formation of apertures.

DEFINITIONS

Figure 1:
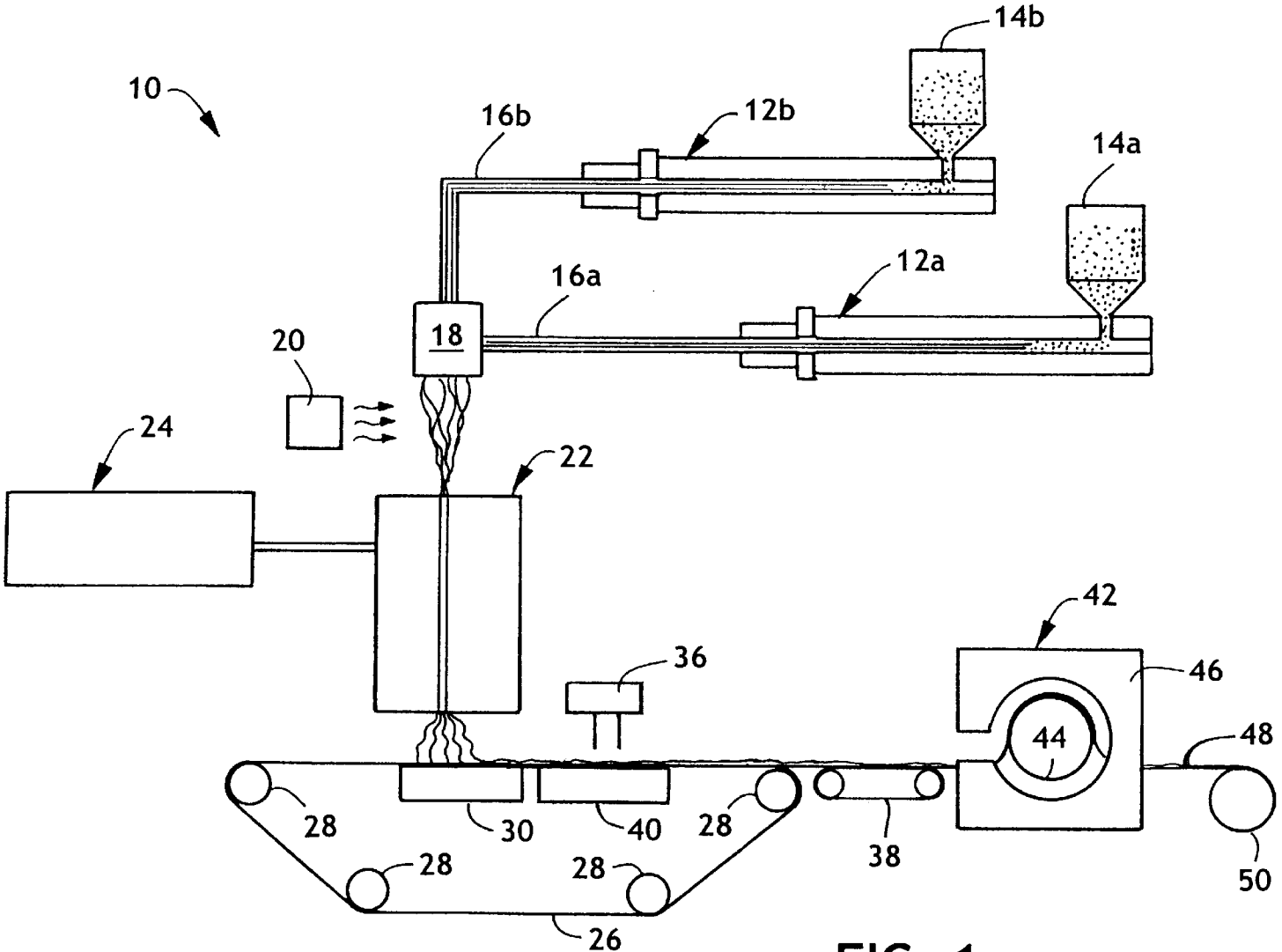
FIG. 1 is a schematic drawing of a process line suitable for practicing the present invention.

As used herein and in the claims, the term "comprising" is inclusive or open-ended and does not exclude additional unrecited elements, compositional components, or method steps.

As used herein the term "nonwoven" fabric or web means a web having a structure of individual filaments or threads which are interlaid, but not in an identifiable manner as in a knitted or woven fabric. Nonwoven fabrics or webs have been formed by many processes including, but not limited to, meltblowing processes, spunbonding processes, hydroentangling, air-laid and bonded-carded web processes.

As used herein the term "substantially continuous" filament means a filament having a length to diameter ratio in excess of about 15,000 to 1, and desirably in excess of 50,000 to 1.

As used herein, "substantial filament entanglement" describes the result wherein the individual fibers or filaments have been intertwined and entangled about one another to such a degree as to give functional integrity to the web structure and form a highly entangled consolidated fibrous structure.

As used herein, the term "machine direction" or MD means the direction of the fabric in the direction in which it is produced. The term "cross machine direction" or CD means the direction of the fabric substantially perpendicular to the MD.

As used herein the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" includes all possible spatial configurations of the molecule. These configurations include, but are not limited to isotactic, syndiotactic and random symmetries. Unless otherwise indicated, polymer properties discussed herein are in reference to pre-spinning properties.

As used herein "pattern bonding" means bonding one or more layers of fabric at numerous small, discrete locations. As one example, thermal point bonding generally involves passing one or more layers to be bonded between heated rolls such as, for example, an engraved or patterned roll and a second roll. The engraved roll is patterned in some way so that the entire fabric is not bonded over its entire surface, and the second roll can either be flat or patterned. As a result, various patterns for engraved rolls have been developed for functional as well as aesthetic reasons. Exemplary bond patterns are described in U.S. Pat. No. 3,855,046 and U.S. Design Pat. No. 375,844 as well as numerous other patents.

As used herein, the term "autogenous bonding" refers to bonding between discrete parts and/or surfaces independently of external additives such as adhesives, solders, mechanical fasteners and the like. As an example, many multicomponent filaments may be autogenously bonded by developing inter-filament bonds at filament contact points without significantly degrading either the web structure or the filament structure. Desirably, autogenous bonding is carried out with a non-compacting process which does not significantly compact or densify the web structure.

DESCRIPTION OF THE INVENTION

As discussed above, the method of the present invention provides an economical process for making an apertured, high-loft nonwoven fabric of crimped multicomponent continuous spunbond filaments. In practicing the method of the present invention, a nonwoven precursor web of multicomponent continuous spunbond filaments is treated by mechanical arrangement of the filaments with hydraulic streams to form apertures. The thus treated nonwoven web is subsequently autogenously bonded to maintain the integrity and loft of the fabric. Fabrics made by the method of the present invention are particularly useful for making personal care articles, garments, medical products, cleaning products, and other products as well.

In practicing the present invention, a loose continuous filament precursor web is treated with liquid streams to arrange the filaments in such a way as to effect apertures through the web. A loose filament web is a web in which the individual filaments lack any substantial amount of bonding to one another such that the individual filaments are free to move in an individual manner under an applied force. The loose continuous filament precursor web is desirably formed by a multicomponent continuous filament spunbond process. Spunbond webs useful in the present invention desirably have basis weights from about 0.25 ounces per square yard (osy) to about 3 osy, and more desirably have basis weights from about 0.5 osy to about 1.5 osy. Spunbond filaments are generally formed by extruding molten thermoplastic material as filaments from a plurality of fine capillaries of a spinneret with the diameter of the extruded filaments then being rapidly reduced. Generally, spunbond filaments can have an average filament diameter between about 10 and about 35 micrometers and still more desirably an average fiber diameter of between about 12 micrometers and about 25 micrometers. Examples of spunbond filaments and methods of making the same are described in U.S. Pat. No. 4,340,563 to Appel et al., U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, U.S. Pat. No. 3,542,615 to Dobo et al, and U.S. Pat. No. 5,382,400 to Pike et al.

The components forming the filaments can comprise one or more melt-processable polymers. The individual components can comprise the same, similar and/or different polymers. However, at least two of the individual components are distinct in that they have selected and distinct melting points. The polymeric components of the multicomponent filaments are desirably selected from thermoplastic polymers including, but are not limited to, polyolefins (e.g., polypropylene and polyethylene), polycondensates (e.g., polyamides, polyesters, polycarbonates, and polyarylates), polyols, polydienes, polyurethanes, polyethers, polyacrylates, polyacetals, polyimides, cellulose esters, polystyrenes and so forth. As particular examples, the polymeric components can comprise polyethylene, polypropylene, poly(1-butene), poly(2-butene), poly(1-pentene), poly(2-pentene), poly(1-methyl-1-pentene), poly (3-methyl-1-pentene), and poly(4-methyl-1-pentene) and so forth. In addition, blends and/or copolymers of the aforesaid polymers are likewise suitable for use in one or more components of the multicomponent filament. The individual components or segments comprising the multicomponent filament can comprise the same polymer or different polymers. By way of example only, desired combinations of polymer segments can comprise polyolefin/polyamide; polyolefin/polyester; polyolefin/polyolefin and so forth. More particularly, examples of suitable polymeric component combinations include, but are not limited to, polypropylene/polyethylene, polypropylene/polypropylene, polyethylene/nylon, polyethylene/polyester and so forth.

Figure 2A:
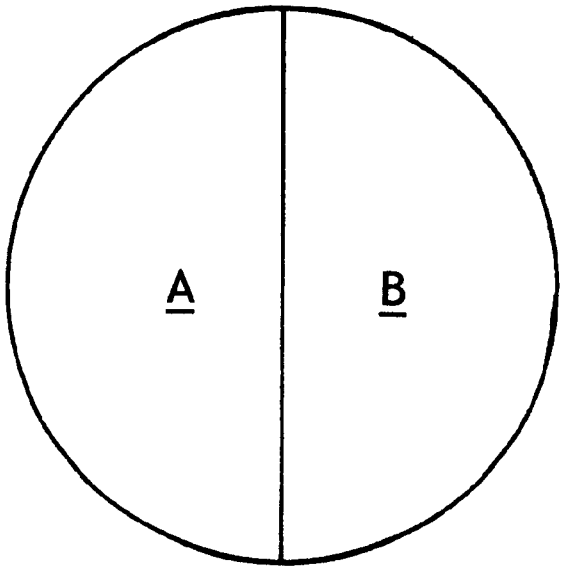
FIG. 2A is a drawing illustrating the cross-section of a multicomponent filament with the polymer components in a side-by-side arrangement.
Figure 2B:
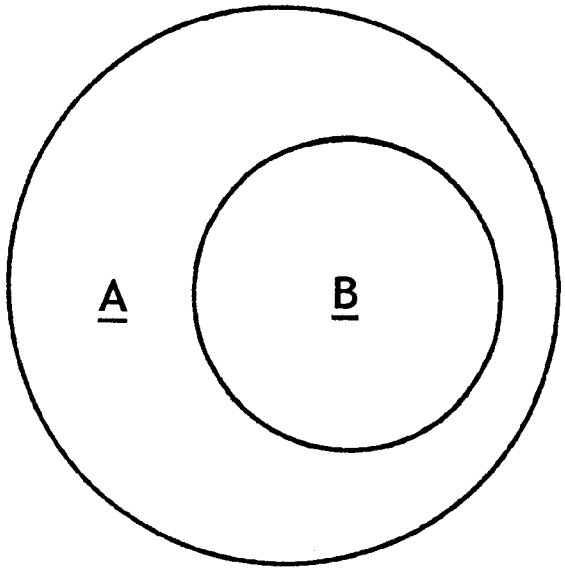
FIG. 2B is a drawing illustrating the cross-section of a multicomponent filament with the polymer components in an eccentric sheath/core arrangement.

A precursor web useful in the method of the present invention is a web of crimped or crimpable multicomponent filaments. Exemplary crimped filaments have a three-dimensional curl such as, for example, a helical crimp as opposed to random two-dimensional waves or undulations in the filament. In reference to FIGS. 2A and 2B, a continuous bicomponent filament comprising a first polymeric component A and a second polymeric component B suitable for producing crimped or crimpable filaments is shown. The first and second components A and B can be arranged in substantially distinct zones within the cross-section of the filament that extend substantially continuously along the length of the filament. The individual components are positioned within the filament cross-section in a crimpable configuration. As an example, the first and second components A and B can be arranged in either a side-by-side arrangement as depicted in FIG. 2A or an eccentric sheath/core arrangement as depicted in FIG. 2B. In eccentric sheath/core filaments, one component fully occludes or surrounds the other but is asymmetrically located in the filament to allow filament crimp. As additional examples, the filaments can comprise combinations of sheath/core and side-by-side arrangement of filaments as shown in reference to FIGS. 2C and 2D. However, it is noted that numerous other cross-sectional configurations and/or filament shapes are suitable for use with the present invention. The respective polymer components can be present in ratios (by volume) of from about 85/15 to about 15/85. Ratios of approximately 50/50 are often desirable; however, the particular ratios employed can vary as desired. In this regard, although the particular process described herein is primarily described with respect to bicomponent filaments, the method of the present invention and materials made therefrom are not limited to such bicomponent structures and other multicomponent configurations, for example configurations using more than two polymers and/or more than two components, are intended to be encompassed by the present invention.

As described above, nonwoven webs made from crimped filaments generally have a lower density, higher loft and improved resiliency compared to similar spunbond filament nonwoven webs comprised of filaments which are not crimped. Nonwoven web density is calculated from the basis weight of the fabric and the fabric thickness or bulk. Fabric thickness or bulk can be measured using an Ames thickness tester Model 3223, under a 3 inch circular platen and a total weight of 0.4 pounds. As examples, the high loft crimped multicomponent continuous filament webs of the invention can have a density equal to or less than about 0.09 grams per cubic centimeter ($g/cm^3$), more desirably between about 0.07 $g/cm^3$ and about 0.005 $g/cm^3$, and still more desirably between about 0.06 $g/cm^3$ and about 0.01 $g/cm^3$.

In one aspect of the present invention, formation of crimp in filaments of the precursor web may be achieved before web formation by activation of the latent helical crimp through the application of heat to the filaments in the draw unit. Such a process is described in U.S. Pat. No. 5,382,400 to Pike et al., the entire contents of which are herein incorporated by reference. In another aspect of the present invention, formation of crimp in the precursor web may be achieved after web formation by activation of latent helical crimp through the application of heat to the web at a time after web formation. Activation of latent crimp by the application of heat is described in, for example, U.S. Pat. No. 3,423,266 to Davies et al., the entire contents of which are herein incorporated by reference. In the case of either precursor web, the polymeric components of the multicomponent filaments comprise polymers that are different from one another in that they have disparate stress or elastic recovery properties, crystallization rates and/or melt viscosities. Such multicomponent filaments can form crimped filaments having a helical crimp in a single continuous direction, that is to say that one polymer will substantially continuously be located on the inside of the helix. Further, in applications where through-air bonding of the web is desirable, one of the polymer components desirably has a melting point at least about 10° C. lower than that of the other component.

Turning to FIG. 1, a process line 10 for an exemplary embodiment of the method of the invention is disclosed. In reference to FIG. 1, the process line 10 is arranged to produce bicomponent continuous filaments, but it should be understood that the present invention encompasses the use of nonwoven fabrics made with multicomponent filaments having more than two components.

The process line 10 includes a pair of extruders 12*a* and 12*b* for separately extruding polymer component A and polymer component B. Polymer component A is fed into the respective extruder 12*a* from a first hopper 14*a* and polymer component B is fed into the respective extruder 12*b* from a second hopper 14*b*. Polymer components A and B are fed from the extruders 12*a* and 12*b* through respective polymer conduits 16*a* and 16*b* to a spinneret 18. Spinnerets for extruding bicomponent filaments are well known to those of ordinary skill in the art and thus are not described here in detail.

Figure 2C:
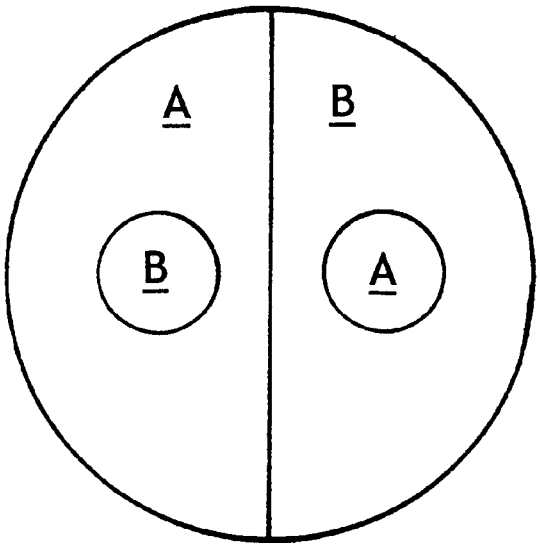
FIG. 2C is a drawing illustrating the cross-section of a multicomponent filament with the polymer components in side-by-side arrangement, wherein each side has polymer components in a sheath/core arrangement.
Figure 2D:
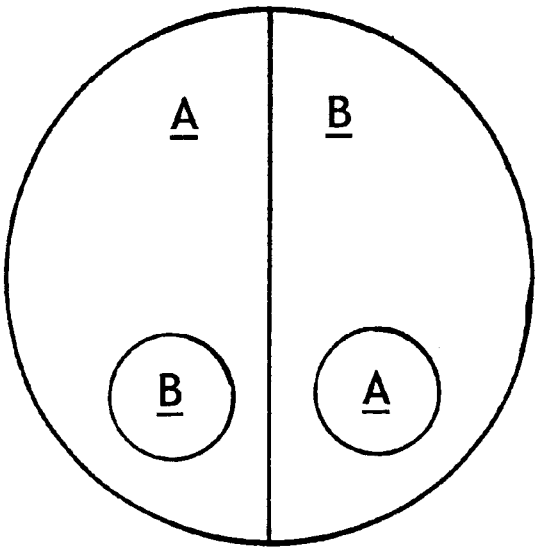
FIG. 2D is a drawing illustrating the cross-section of a multicomponent filament with the polymer components in side-by-side arrangement, wherein each side has polymer components in an eccentric sheath/core arrangement.

Generally described, the spinneret 18 includes a housing containing a spin pack which includes a plurality of plates stacked one on top of the other with a pattern of openings arranged to create flow paths for directing polymer components A and B separately through the spinneret. An exemplary spin pack for producing multicomponent filaments is described in U.S. Pat. No. 5,989,004 to Cook, the entire contents of which are herein incorporated by reference. The spinneret 18 has openings arranged in one or more rows. The spinneret openings form a downwardly extending curtain of filaments when the polymers are extruded through the spinneret. For the purposes of the present invention, spinneret 18 may be arranged to form side-by-side or sheath/core bicomponent filaments as illustrated in FIGS. 2A and 2B. Other filament cross sections believed suitable are combination side-by-side sheath/core bicomponent filaments as illustrated in FIGS. 2C and 2D.

The process line 10 also includes a quench blower 20 positioned adjacent the curtain of filaments extending from the spinneret 18. Air from the quench air blower 20 quenches the filaments extending from the spinneret 18. The quench air can be directed from one side of the filament curtain as shown in FIG. 1, or both sides of the filament curtain. As used herein, the term "quench" simply means reducing the temperature of the filaments using a medium that is cooler than the filaments such as using, for example, ambient air.

A filament draw unit or aspirator 22 is positioned below the spinneret 18 and the quench blower 20 and receives the quenched filaments. Filament draw units or aspirators for use in melt spinning polymers are well known. Suitable filament draw units for use in the method of the present invention include, for example, a linear filament aspirator of the type shown in U.S. Pat. No. 3,802,817 and eductive guns of the type shown in U.S. Pat. No. 3,692,618 and U.S. Pat. No. 3,423,266, the disclosures of which are incorporated herein by reference.

Generally described, the filament draw unit 22 includes an elongate vertical passage through which the filaments are drawn by aspirating air entering from the sides of the passage and flowing downwardly through the passage. Aspirating air is supplied by blower 24. The aspirating air may be heated or unheated. The aspirating air pulls the filaments through the passage of the filament draw unit 22 and attenuates the filaments, that is, reduces the diameter of the filaments. When it is desired to activate latent helical crimp in the filaments prior to filament laydown, the blower 24 supplies heated aspirating air to the filament draw unit 22. In this respect, the heated aspirating air both attenuates the filaments and activates the latent helical crimp. When it is desired to activate the latent helical crimp in the filaments at some point following filament laydown the blower 24 supplies unheated aspirating air to filament draw unit 22. In this instance, heat to activate the latent crimp would be supplied to the web at some point after filament laydown, which point could be either before or after the hydraulic arrangement step.

An endless foraminous forming surface 26 is positioned below the filament draw unit 22 to receive the attenuated filaments from the outlet opening of the filament draw unit 22. The foraminous forming surface 26 travels around guide rollers 28. A vacuum 30 positioned below the foraminous forming surface 26 pulls the attenuated filaments onto foraminous forming surface 26. The filaments received onto foraminous forming surface 26 comprise a nonwoven web of loose continuous filaments.

The process line 10 further includes a hydraulic arrangement station 36 which is capable of spraying downwardly streams of liquid across the entire cross machine direction distance of the nonwoven web. The nonwoven web of loose continuous filaments is transported by foraminous forming surface 26 through the hydraulic arrangement station 36. Positioned below the hydraulic arrangement station 36 and immediately below foraminous forming surface 26 is a liquid receiver 40 which collects and transports the liquid away from the process. Liquid receiver 40 may simply act as a drainage basin or may desirably be a vacuum source to more efficiently aid in removal of excess liquid from process and from the nonwoven web.

Foraminous forming surface 26 has elevated portions upon its surface. These elevated portions upon the surface may be in the form of knuckles on a conventional forming wire, or in the form of raised protuberances or knobs attached to the forming surface. As the nonwoven web of loose continuous filaments is carried under the hydraulic arrangement station 36 by foraminous forming surface 26, the streams of liquid penetrate the nonwoven web and the liquid passes through foraminous forming surface 26. The action of the liquid streams on the loose continuous filaments of the nonwoven web causes the loose filaments to be moved away from the elevated portions of the surface of foraminous forming surface 26. In this manner, by being moved away from the elevated portions, the loose continuous filaments are arranged to form apertures in those areas corresponding to the elevated portions of foraminous forming surface 26. Different patterns of apertures, different sizes of individual apertures, and/or different numbers of apertures per unit area of the nonwoven fabric may be produced in the nonwoven web by selection the configuration, size, and/or number of raised protuberances on foraminous forming surface 26. By way of example only, the number of elevated portions per square inch may number as many as 400 or higher. Also by way of example only, where raised protuberances are used, the shape of protuberances may be selected to effect apertures of desired shapes, such as a hemispherical protuberance for a substantially circular aperture or an elongate protuberance for an elongated aperture.

The liquid streams from hydraulic arrangement station 36, unlike those used in hydroentangling processes known in the art, do not have as their object the purpose of imparting substantial filament entanglement. Therefore, the liquid streams from hydraulic arrangement station 36 can impart apertures to the loose continuous filament web at pressures much lower than are used in hydroentangling. Indeed, it is undesirable to deliver the liquid at too high a pressure as this would deleteriously impact the loftiness of the web. Therefore, it is desirable for the liquid streams to be delivered from hydraulic arrangement station 36 at less than 100 pounds per square inch (psi), and more desirably at less than 70 pounds per square inch. In addition, the means by which the liquid streams are supplied may be much simpler and cheaper than the expensive nozzles required to supply the high-pressure, needle fine jets used in hydroentangling. As an example, inexpensive and relatively simple conventional solid cone nozzles may be used. As an alternative example, the filament arranging force supplied by hydraulic arrangement station 36 may be provided as a liquid curtain which flows over a spillway to free-fall onto the web of loose continuous filaments with sufficient force to cause movement of the loose filaments. The amount of force desired to be delivered by the liquid curtain may be adjusted by changing the flow volume of liquid and the height from which it falls onto the web of loose continuous filaments.

The process line 10 further includes a bonding device such as the through-air bonder 42. Through-air bonders are well known to those skilled in the art and are not disclosed here in detail. In reference to FIG. 1, conveyor 38 transfers the web of arranged continuous filaments from foraminous forming surface 26 to the through-air bonder 42. Through-air bonder 42 directs a stream of hot air through the web of continuous bicomponent filaments thereby forming inter-filament bonds. Desirably the through-air bonder 42 utilizes air having a temperature at about or above the polymer melting temperature of the lower melting polymer component and below the melting temperature of higher melting polymer component. The heated air is directed from the hood 46, through the web, and into the perforated roller 44. The hot air melts the lower melting polymer component and thereby forms durable nonwoven web 48 having autogenous bonds between the bicomponent filaments at filament contact points. However, since the air temperature is desirably below the melting temperature of the higher melting polymer component, the high melting polymer component does not significantly soften and the web substantially retains its dimensional structure. The desired dwell time and air temperature will vary with the particular polymers selected, the desired degree of bonding and other factors known to those skilled in the art. However, through-air bonding will often be more desirable in those particular embodiments where the polymers forming the respective components have melting points at least about 10° C. apart, and even more desirably at least about 20° C. apart.

Figure 3:
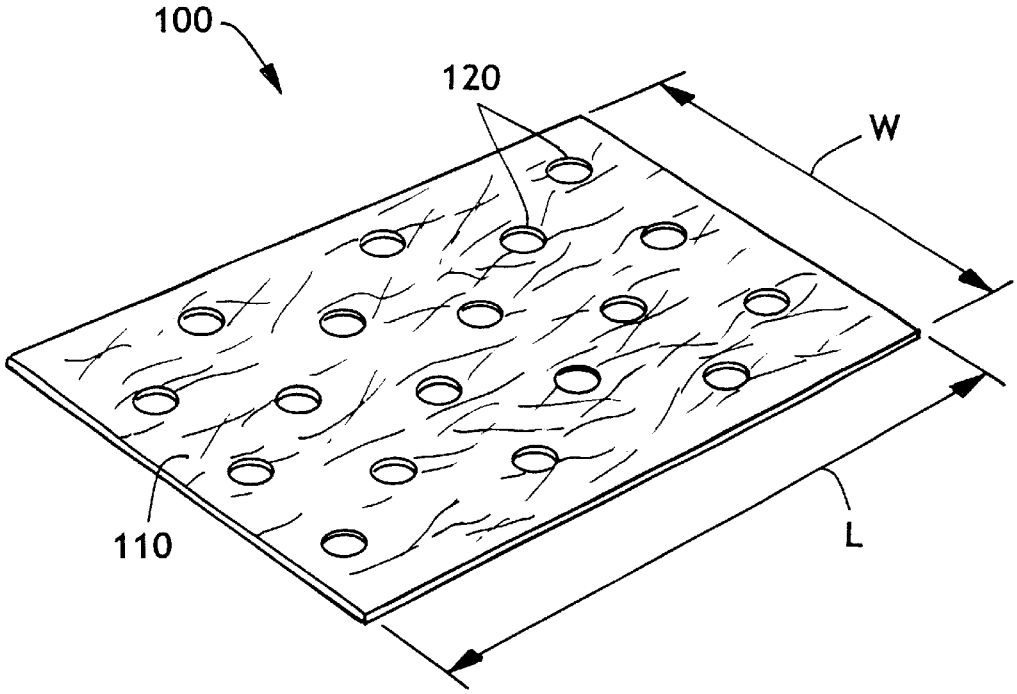
FIG. 3 is a schematic drawing of an exemplary nonwoven fabric of the present invention.

Lastly, the process line 10 further includes a winding roll 50 for taking up the finished fabric. FIG. 3 is a schematic drawing of an exemplary nonwoven fabric of the present invention wherein fabric 100 comprises both land areas 110 comprising bicomponent fibers and apertures 120. While not shown here, various additional potential processing and/or finishing steps known in the art such as web slitting, stretching, treating, or lamination of the apertured nonwoven fabric into a composite with other materials, such as films or other nonwoven layers, may be performed without departing from the spirit and scope of the invention. Examples of web treatments include electret treatment to induce a permanent electrostatic charge in the web, or in the alternative antistatic treatments. Another example of web treatment includes treatment to impart wettability or hydrophilicity to a web comprising hydrophobic thermoplastic material. Wettability treatment additives may be incorporated into the polymer melt as an internal treatment, or may be added topically at some point following filament or web formation. Advantageously, a topical wettability additive may be incorporated into the fluid used in the hydraulic arrangement station so that wettability treatment is carried out contemporaneously with the filament arrangement step. As a further example, depending on fabric basis weight and wettability of the fabric components, it may be desirable to implement a drying processing step to fully dry the web prior to autogenously bonding the web. An example of a drying step well known in the art is the use of drying cans which are steam heated to a temperature sufficient to remove excess moisture from the nonwoven fabric without damaging the structure of the nonwoven fabric.

In addition, it will be appreciated by those skilled in the art that various specific process steps and/or parameters could be varied in numerous respects without departing from the spirit and scope of the invention. For example, the hydraulic arrangement step whereby the apertures are formed may be accomplished on other apparatus known in the art such as on a perforated rotatable drum. In this aspect the nonwoven web travels along the outside surface of the perforated rotatable drum, outwardly supported by a foraminous support surface. The foraminous support surface in this instance is for support only and need not have elevated portions upon its surface. The liquid streams are sprayed outwardly from inside the drum and are able to spray through the drum at the drum perforations. As the liquid streams spray through the perforations the liquid streams penetrate the nonwoven web at the sites of the drum perforations, moving the loose continuous filaments aside to arrange the loose continuous filaments to form apertures in those areas corresponding to the drum perforations.

As another example, the molten filaments may be melt-attenuated utilizing other apparatus known in the art. As an additional example, while the multicomponent filaments of the present invention can be autogenously bonded by the use of through-air bonding, the filaments of the loose filament web may also be autogenously bonded by other means such as the use of infrared radiation or microwaves.

The apertured nonwoven fabrics of the present invention have a great variety of uses and include, but are not limited to, articles or components of articles such as absorbent personal care products, garments, medical products, cleaning products, and so forth. As specific examples nonwoven personal care products include personal hygienic care items such as facial and body wipes, infant care items such as diapers and baby wipes, child care items such as training pants, feminine care items such as sanitary napkins, and adult care items such as incontinence products. Examples of nonwoven garments include protective workwear and medical apparel such as surgical gowns. Other nonwoven medical products include nonwoven wound dressings, surgical sponges and surgical dressings. Cleaning product uses for nonwovens include towels and wipes.

More specific examples of uses for the apertured nonwoven fabrics of the invention as components of personal care articles include, but are not limited to, fluid management layers such as fluid distribution or retention layers, and body side skin contact layers or liners for intake and transport of high and/or low viscosity bodily fluids.

Numerous other patents have been referred to in the specification and to the extent there is any conflict or discrepancy between the teachings incorporated by reference and that of the present specification, the present specification shall control. Additionally, while the invention has been described in detail with respect to specific embodiments thereof, it will be apparent to those skilled in the art that various alterations, modifications and/or other changes may be made without departing from the spirit and scope of the present invention. It is therefore intended that all such modifications, alterations and other changes be encompassed by the claims.

We claim:

1. A process of forming a nonwoven fabric, comprising:

(a) forming a lofty precursor web of substantially continuous multicomponent filaments, wherein the web has a density of about 0.09 grams per cubic centimeter or less;

(b) exposing the precursor web to a hydraulic arrangement treatment to form apertures, wherein said hydraulic arrangement treatment is performed without imparting substantial filament entanglement; and thereafter (c) autogenously bonding the web, wherein the bonded web has a density of about 0.09 grams per cubic centimeter or less.

2. The process according to claim 1 wherein the lofty precursor web comprises a web of substantially loose multicomponent filaments.

3. The process according to claim 2 wherein the lofty precursor web comprises crimped multicomponent filaments.

4. The process according to claim 1 wherein said hydraulic arrangement treatment comprises application of liquid streams at about 100 pounds per square inch or less.

5. The process according to claim 4 wherein said hydraulic arrangement treatment comprises application of liquid streams at about 70 pounds per square inch or less.

6. The process according to claim 1 wherein the step of autogenously bonding the web comprises forming interfilament bonds using heated air.

7. The process according to claim 1 wherein the components of said multicomponent filaments are selected from the group consisting of polyolefins, polyesters, polyamides, and polyurethanes.

8. The process according to claim 1 wherein the components of said multicomponent filaments comprise polypropylene and polyethylene.

9. The process according to claim 1 wherein said continuous multicomponent filaments are formed by a spunbonding process.

10. The process according to claim 9 wherein said continuous multicomponent filaments have an average filament diameter greater than about 10 micrometers.

11. A process of forming a nonwoven fabric, comprising:

(a) forming a precursor web of substantially continuous multicomponent filaments;

(b) exposing the precursor web to a hydraulic arrangement treatment to form apertures, wherein said hydraulic arrangement treatment is performed without imparting substantial filament entanglement: and thereafter (c) autogenously bonding the web.

12. The process according to claim 11 wherein the precursor web comprises a web of substantially loose multicomponent filaments.

13. The process according to claim 11 wherein the precursor web comprises multicomponent filaments having latent crimp.

14. The process according to claim 13 wherein said latent crimp is activated during the step of autogenously bonding the web.

15. The process according to claim 11 wherein said hydraulic arrangement treatment comprises application of liquid streams at about 100 pounds per square inch or less.

16. The process according to claim 15 wherein said hydraulic arrangement treatment comprises application of liquid streams at about 70 pounds per square inch or less.

17. The process according to claim 11 wherein the step of autogenously bonding the web comprises forming interfilament bonds using heated air.

18. The process according to claim 11 wherein the components of said multicomponent filaments are selected from the group consisting of polyolefins, polyesters, polyamides, and polyurethanes.

19. The process according to claim 18 wherein the components of said multicomponent filaments comprise polypropylene and polyethylene.

20. The process according to claim 11 wherein said continuous multicomponent filaments are formed by a spunbonding process.

* * * * *